US006436269B1

(12) United States Patent
Opaskar et al.

(10) Patent No.: US 6,436,269 B1
(45) Date of Patent: Aug. 20, 2002

(54) PLATING BATH AND METHOD FOR ELECTROPLATING TIN-ZINC ALLOYS

(75) Inventors: Vincent C. Opaskar, Chagrin Falls, OH (US); Lee Desmond Capper, Wolverhampton (GB)

(73) Assignee: Atotech Deutschland GmbH, Berlin (DE)

( * ) Notice: Subject to any disclaimer, the term of this patent is extended or adjusted under 35 U.S.C. 154(b) by 97 days.

(21) Appl. No.: 09/691,985

(22) Filed: Oct. 19, 2000

(51) Int. Cl.[7] ..... C25D 3/60
(52) U.S. Cl. ..... 205/253; 205/244; 205/254
(58) Field of Search ..... 205/244, 245, 205/246, 253, 254, 301, 302; 106/122, 125

(56) References Cited

U.S. PATENT DOCUMENTS

| | | | | | |
|---|---|---|---|---|---|
| 4,157,388 | A | | 6/1979 | Christiansen | 424/70 |
| 4,163,700 | A | | 8/1979 | Igarashi et al. | 205/253 |
| 4,168,223 | A | | 9/1979 | Igarashi et al. | 205/253 |
| 4,614,568 | A | * | 9/1986 | Okubo et al. | 205/205 |
| 4,717,458 | A | * | 1/1988 | Martin et al. | 205/246 |
| 5,405,523 | A | | 4/1995 | Eckles | 205/245 |
| 5,435,898 | A | * | 7/1995 | Commander et al. | 205/245 |
| 5,618,402 | A | | 4/1997 | Sakurai et al. | 205/244 |
| 5,951,841 | A | * | 9/1999 | Wehlage et al. | 205/261 |

FOREIGN PATENT DOCUMENTS

| | | |
|---|---|---|
| EP | 0 663 460 A1 | 7/1995 |
| WO | 00/17420 | 3/2000 |

OTHER PUBLICATIONS

A. Rose et al, The Condensed Chemical Dictionary, seventh edition, Reinhold Book Corp., New York, pp. 373, 395, 1966.*

European Search Report, Application No. EP 01 12 4311, dated Mar. 21, 2002.

* cited by examiner

*Primary Examiner*—Donald R. Valentine
*Assistant Examiner*—William T. Leader
(74) *Attorney, Agent, or Firm*—Renner, Otto, Boisselle & Sklar, LLP

(57) ABSTRACT

The present invention relates to an aqueous plating bath for electrodeposition of tin-zinc alloys comprising at least one bath-soluble stannous salt, at least one bath soluble zinc salt, and a quaternary ammonium polymer selected from a ureylene quaternary ammonium polymer, an iminoureylene quaternary ammonium polymer or a thioureylene quaternary ammonium polymer. The plating baths also may contain one or more of the following additives: hydroxy polycarboxylic acids or salts thereof such as citric acid; ammonium salts; conducting salts; aromatic carbonyl-containing compounds; polymers of aliphatic amines such as a poly(alkyleneimine); and hydroxyalkyl substituted diamines as metal complexing agents. The plating baths of this invention deposit a bright and level deposit, and they can be adapted to provide plated alloys having high tin concentration over a wide current density range.

46 Claims, No Drawings

PLATING BATH AND METHOD FOR ELECTROPLATING TIN-ZINC ALLOYS

FIELD OF THE INVENTION

This invention relates to the electrodeposition of tin-zinc alloys. The invention also relates to a plating bath for depositing tin-zinc alloy coatings on various substrates.

BACKGROUND OF THE INVENTION

The electrodeposition of tin and various tin alloys has been widely employed to protect steel and similar metal materials from corrosion, or to improve the solderability of the metals.

Tin-zinc alloy plating baths have been described in the prior art. The use of citric acid or salts of citric acid, and ammonium salts in the electroplating baths is known. In U.S. Pat. No. 4,163,700, it has been suggested even when tin-zinc electroplating baths containing citric acid are used, there is still a disadvantage in that when a metallic ion concentration in the bath gradually increases as the charged current is increased, an insoluble substance (considered to be a stannate or other metallic salt) is formed on the anode of tin or tin alloy and then released from the cathode to be plated which gives an undesirable effect on the plated surface. Accordingly, in the '700 patent, the patentee suggests the tin or tin alloy electroplating baths which contain citric acid or its salt and an ammonium salt can be improved by adding to the bath, at least one saturated hydroxy carboxylic acid or its salt, other than citric acid, and/or at least one saturated dibasic carboxylic acid or its salt.

U.S. Pat. No. 4,168,223 also describes an electroplating bath for depositing tin or a tin alloy such as a tin-zinc alloy with satisfactory brightness. The electroplating bath comprises a bath having a pH value ranging from 4 to 8 and containing citric acid or its salts, an ammonium salt, and a water-soluble polymer as a brightener. The bath may further comprise an aldehyde compound as a co-brightener. The water-soluble polymers useful as brighteners in these plating baths include polyoxyethylenes, derivatives thereof, or the reaction products of an epoxy compound with ethylene glycol, propylene glycol or glycerine.

U.S. Pat. No. 5,618,402 describes a tin-zinc alloy electroplating bath which comprises a water-soluble stannous salt, a water-soluble zinc salt, and amphoteric surfactant, and water. The amphoteric surfactant useable in the plating baths include those of imidazoline, betaine, alanine, glycine and amide types. The baths also may contain hydroxy carboxylic acids such as citric acid or gluconic acid.

Zinc alloy plating baths containing a quaternary ammonium polymer are described in U.S. Pat. No. 5,405,523. The electroplating baths described in the '523 patent comprise zinc ions, alloy metal ions of a metal of the first transition series of the Periodic Table and a quaternary ammonium polymer as a brightener. The electroplating baths can be either alkaline baths having a pH in the range of from about 9 to 13 or acid baths having a pH in the range of from 3 to 7. The quaternary ammonium polymers useful in the plating baths include a ureylene quaternary ammonium polymer, an iminoureylene quaternary ammonium polymer or a thioureylene quaternary ammonium polymer.

SUMMARY OF THE INVENTION

The present invention relates to an aqueous plating bath for electrodeposition of tin-zinc alloys comprising at least one bath-soluble stannous salt, at least one bath soluble zinc salt, and a quaternary ammonium polymer selected from a ureylene quaternary ammonium polymer, an iminoureylene quaternary ammonium polymer or a thioureylene quaternary ammonium polymer. The plating baths also may contain one or more of the following additives: hydroxy polycarboxylic acids or salts thereof such as citric acid; ammonium salts; conducting salts; aromatic carbonyl-containing compounds; polymers of aliphatic amines such as a poly(alkyleneimine); and hydroxyalkyl substituted diamines as metal complexing agents. The plating baths of this invention deposit a bright and level deposit, and they can be adapted to provide plated alloys having high tin concentration over a wide current density range.

DETAILED DESCRIPTION OF THE INVENTION

The aqueous plating baths of the present invention comprise an aqueous composition comprising stannous ions in the form of at least one bath-soluble stannous salt, zinc ions in the form of at least one bath soluble zinc salt, and a quaternary ammonium polymer selected from a ureylene quaternary ammonium polymer, an iminoureylene quaternary ammonium polymer or a thioureylene quaternary ammonium polymer. In one embodiment, the baths also contain at least one hydroxy polycarboxylic acid such as citric acid. If the acidity of the bath falls below the desired operating range of from about 4 to about 8, or from 5 to about 7, the pH can be increased by the addition of ammonium hydroxide or an alkali metal hydroxide such as sodium hydroxide or potassium hydroxide.

The plating bath of the present invention generally will contain stannous ion at concentrations of from about 1 g/l to about 100 g/l, and zinc ions at a concentration of from about 0.2 to about 80 g/l. In another embodiment, the plating baths will contain from about 5 g/l to about 40 g/l of stannous ions and from about 5 to about 50 g/l of zinc ions. In yet another embodiment, the plating bath may contain from about 10 to about 20 g/l of stannous ion and from about 10 to about 40 g/l of zinc ions. Throughout this written description of the invention, the range and ratio limits may be combined.

The stannous ion may be in the form of a soluble salt such as stannous sulfate, stannous chloride, stannous fluoride, stannous sulfamate, stannous acetate, stannous oxide, stannous methane sulfonate etc. The zinc ion may be present in the bath in the form of a soluble salt such as zinc sulfate, zinc chloride, stannous fluoride, zinc fluoroborate, zinc sulfamate, zinc acetate, etc. Mixtures of the stannous salts and/or zinc salts may be utilized to provide the desired concentration of tin and zinc. In one embodiment, the stannous ions and the zinc ions are both present as the chloride salts.

The relative and total amounts of stannous ions and zinc ions in the electroplating baths of the invention will influence the tin-zinc alloy distribution, and the appearance of the deposit. When a plating bath is too low in total metal (e.g., less than 5 g/l) gas streaking in the high current density range (greater than 40 ASF to 20 ASF) and the mid current density range (20 ASF to 8 ASF) will result. The ratio of metals also effects the alloy content. For example, other things being equal, a bath containing a greater amount of tin will deposit an alloy containing higher tin than a plating bath containing a lower concentration of tin.

The plating baths of the present invention can be utilized to deposit tin-zinc alloys comprise about 50%w up to about 95%w or more of tin and about 5%w up to about 50%w of zinc. Alloys containing about 70–80% of tin and 20 to 30% of zinc are useful in corrosion prevention (for example, of fasteners) and alloys containing about 90% tin and about 10% zinc are useful in electronic applications where soldering is required.

The electroplating baths of the present invention also contain at least one quaternary ammonium polymer which may be a ureylene quaternary ammonium polymer, an iminoureylene quaternary ammonium polymer or a thioureylene quaternary ammonium polymer. The amount of the quaternary ammonium polymer included in the tin-zinc alloy plating baths is an amount sufficient to provide desired improvements in the deposited tin-zinc alloy such as reduced burning of the high current density deposits, and improved grain refinement. When used with brightener compositions such as aromatic aldehydes and ketones (described more fully below), improved brightness is obtained. Generally, the tin-zinc alloy plating baths will contain from about 0.2 to about 2.5 g/l of the quaternary ammonium polymer. In another embodiment the bath will contain from about 0.5 to about 2.0 g/l of the quaternary ammonium polymer.

Quaternary ammonium polymers which are useful in the present invention may be prepared by condensation copolymerization of one or more ditertiary amine monomers with one or more aliphatic dihalides. In one embodiment, the ditertiary amines useful in the copolymerization reaction may be represented by Formula II $$(R)(R)N—(CH_2)_a—NHC(Y)NH—(CH_2)_b—N(R)(R) \qquad \text{II}$$

wherein each R is independently a methyl, ethyl, isopropyl, hydroxymethyl, hydroxyethyl, or $—CH_2CH(OCH_2CH_2)_c$ OH group; a, b and c are each independently 1 to about 6; and Y is O, S, or NH. In one embodiment, each R is a methyl group and Y is O. In another embodiment, a and b are each independently 2 or 3.

The ditertiary amine represented by Formula II can be prepared by reacting one mole of urea, thiourea or guanidine with two moles of a diamine containing one tertiary amine group and either one primary or one secondary amine group (preferably an amine having one tertiary and one primary amine group) as represented by Formula I.

$$R(R)N—(CH_2)_a—N(R^7)H \qquad \text{I}$$

wherein R is as defined in Formula II, $R^7$=R or H, and a is 1 to about 6. In one embodiment, $R^7$ is hydrogen. Specific examples of such diamines include dimethyl aminoethyl amine, 3(dimethylaminopropyl)amine, and 3(diethylamino) propylamine.

In one embodiment, each R in Formula II (and $R^7$ Formula I) is independently a methyl group, a, b and c are each independently 2 or 3 and Y is O. In another embodiment, each R in Formula II is a methyl group, Y is O and a and b are 3.

Generally the ditertiary amine (II) is formed by heating together the diamine of Formula I and urea, thiourea or guanidine at an elevated temperature, removing ammonia with a vacuum or by bubbling gas such as air or nitrogen through the reaction mass. Temperatures as high as 80° C. may be used.

The aliphatic dihalide which is reacted with the ditertiary amine of Formula II can be represented by Formula III.

$$X—R^1—X \qquad \text{III}$$

wherein X is a halide, and $R^1$ is $(CH_2)_d$ or $-[(CH_2)_eO(CH_2)_f]_g$ where d, e and f are each independently from 1 to about 6, and g is from 1 to about 4. Specific examples of such dihalides include compounds of the formulae: $Cl—CH_2OCH_2—Cl$; $Cl—CH_2CH_2OCH_2CH_2—Cl$; $Cl—CH_2CH_2—OCH_2CH_2OCH_2CH_2—Cl$; $Cl—CH_2CH_2—Cl$, $Br—CH_2CH_2—Br$; $Cl—CH_2CH_2CH_2—Cl$; $Cl—CH_2CH_2CH_2CH_2—Cl$; etc.

The quaternary ammonium polymer is obtained when the ditertiary amine represented by Formula II is reacted with the dihalide of Formula III. The ditertiary amine (II) may be dissolved in water, in alcohol, or in another suitable solvent and condensed with dihalide (III) to form the desired polymer. Alternatively, the reaction can be carried out in the absence of a diluent. Toward the end of the reaction, chain terminating agents may be added if appropriate. The reaction of the ditertiary amine and the dihalide is carried out at elevated temperatures such as, for example, from about 35° C. to about 120° C. The progress of the reaction can be followed by analyzing for free halide ion or for tertiary amine. A chain terminating agent may be added to control the molecular weight of the polymer or to alter the characteristics of the polymer. Although not wishing to be bound by any theory or formula, it is believed that the quaternary ammonium polymer formed in this manner may be characterized by the following formula IV.

$$-[\overset{\oplus}{N}(R)(R)—(CH_2)_a—N(H)—C(Y)—N(H)—(CH_2)_b—\overset{\oplus}{N}(R)(R)—R^1]_n\ 2nX^- \qquad \text{IV}$$

where each R is independently a methyl, ethyl, isopropyl, hydroxymethyl, hydroxyethyl, or $—CH_2CH_2(OCH_2CH_2)_c$ OH group; Y is O, S, or NH; a, b and c are each independently 1–6; and $R^1$ is $(CH_2)_d$ or $-[(CH_2)_eO(CH_2)_f]_g$ where d, e and f are each independently from 1 to about 6, and g is from 1 to about 4; n is at least 1 and $X^-$ is a halide ion.

The molecular weight of the quaternary ammonium polymers may range from about 300 to about 100,000. In one embodiment, the molecular weight of the polymer is from about 350 to 3000.

The quaternary ammonium polymers which are useful in the present invention and the procedure for preparing the polymers which have been described above, are disclosed in more detail in U.S. Pat. No. 4,157,388. The disclosure of U.S. Pat. No. 4,157,388 is hereby incorporated by reference.

A ureylene quaternary ammonium polymer which has been found to be useful in the plating baths of the present invention is one that is available commercially from the Miranol Chemical Company under the trademark Mirapol A-15. It is believed that this product is one that is prepared by the sequence of reactions which include: dimethylamino propyl amine (2 moles) with 1 mole of urea to form the ditertiary amine monomer as represented above in Formula II, and the ditertiary amine monomer is then subjected to a second condensation reaction with bis(2-haloethyl) ether to form the desired quaternary ammonium polymer which is believed to have an average molecular weight of about 2200.

The plating baths of the invention generally may contain one or more conducting salts such as sodium chloride, sodium fluoride, sodium sulfate, potassium chloride, potassium fluoride, potassium sulfate and, ammonium chloride, ammonium fluoride, and ammonium sulfate. The conductive salts may be present in the plating baths in amounts ranging from about 50 to about 300 g/l or more. In one embodiment, the conductive salt is a chloride, the stannous salt is a chloride, and the zinc salt is a chloride, thus forming an "all chloride" plating bath. In one embodiment, the presence of the chloride in the bath appears to promote the corrosion of the anode which is desirable to prevent or reduce polarization of the anode and oxidation of stannous to stannic ion on the surface of the anode. The chloride enables the anode to dissolve more uniformly from the stannous oxide film normally formed on the surface of the anode. In one embodiment, the amount of chloride ion in the bath is about 1.0 to about 1.7 moles of chloride ion per mole of total metal ions ($Sn^{++}$ and $Zn^{++}$). If the mole ratio is 2 or more, it is believed that the metal/citrate complex may incorporate excess chloride into its structure, and the chloride ion containing complex becomes susceptible to hydrolysis.

The plating baths of the present invention also may contain at least one hydroxy polycarboxylic acid containing from 3 to about 15 carbon atoms, or a water soluble salt thereof. In one embodiment the hydroxy polycarboxylic acids contain 3 to 7 carbon atoms. Mixtures of the hydroxy polycarboxylic acids can be utilized. Examples of hydroxy polycarboxylic acids which can be utilized in the plating baths of the present invention include monohydroxy and polyhydroxy polycarboxylic acids such as tartaric acid, malic acid, citric acid, gluconic acid, and their sodium, potassium or ammonium salts. Citric acid is a particularly useful hydroxy polycarboxylic acid in the electroplating baths of the present invention. The amount of the hydroxy polycarboxylic acid (e.g., citric acid) incorporated into the plating baths of the invention generally is at least 2 moles per mole of combined stannous and zinc ions. Both metal ions form complexes with citric acid. Accordingly, from about 50 to about 200 g/l of citric acid is included in the tin-zinc plating baths. In another embodiment, the baths contain from 75 to 150 g/l of citric acid.

In some instances, the aqueous tin-zinc alloy plating baths of the present invention also may contain one or more brightener compounds known in the art. In one embodiment the plating baths contain at least one brightener selected from aromatic carbonyl-containing compounds. The carbonyl compounds are useful in improving the brightness and luster of the deposits produced by the aqueous tin-zinc plating baths of the present invention. The aromatic carbonyl-containing compounds act as a brightener imparting optimum leveling action over a wider plating range. The aromatic carbonyl-containing compounds may be aromatic aldehydes, ketones, or carboxylic acids or the soluble salts thereof. In one embodiment, the carbonyl-containing compounds include aromatic aldehydes, acetophenones, and carbonyl compounds having the general formula $$Ar\ C(H)=C(H)—C(O)—CH_3$$

wherein Ar is a phenyl, napthyl, pyridyl, thiophenyl or furyl group. Examples of aromatic aldehydes containing a phenyl group include: benzaldehyde; o-chlorobenzaldehyde; o-hydroxybenzaldehyde; o-aminobenzaldehyde; veratraldehyde; 2,4-dichlorobenzaldehyde; 3,4-dichlorobenzaldehyde, 3,5-dichlorobenzaldehyde; 2,6-dichlorobenzaldehyde; tolualdehyde; 3,4-dimethoxybenzaldehyde; cinnamaldehyde; and anisaldehyde. Examples of the naphaldehydes include 1-naphthaldehyde; 2-naphthaldehyde; 2-methoxy-1-naphthaldehyde; 2-hydroxy-1-naphthaldehyde; 2-ethoxy-1-naphthaldehyde; 4-methoxy-1-naphthaldehyde; 4-ethoxy-1-naphthaldehyde; and 4-hydroxy-1-naphthaldehyde. In some applications, a combination of the naphthaldehyde with a benzaldehyde such as 1-naphthaldehyde with 2,6-dichlorobenzaldehyde provides a superior deposit on the substrates. Examples of other carbonyl compounds include aromatic aldehydes and aromatic ketones such as benzylidene acetone, coumarin, acetophenone, propiophenone, 3-methoxybenzol acetone. Other carbonyl compounds include furfurylidine acetone, 3-indole carboxyaldehyde and thiophene carboxyaldehyde. The amount of aromatic aldehyde or other carbonyl containing compound included in the baths of the invention will range up to about 2 grams per liter of bath and preferably is from about 0.005 to about 2 grams per liter of bath. The aldehyde brighteners generally are added to the electroplating baths as a bisulfite addition product.

Mixtures of aliphatic aldehydes and the above-described aromatic aldehydes, and mixtures of naphthaldehydes and benzaldehydes also are useful. Examples of suitable combinations include: the mixture of acetaldehyde and 4-methoxy-1-naphthaldehyde; the mixture of formaldehyde, 1-naphthaldehyde, and 2,6-dichlorobenzaldehyde; etc.

Other useful aromatic carboxyl containing brightener compounds include the aromatic carboxylic acids and salts such as benzoic acid, sodium benzoate, sodium salicylate, and 3-pyridine carboxylic acid (nicotinic acid).

The tin-zinc plating baths of the present invention also may contain at least one polymer of an aliphatic amine as a supplemental brightener and as a grain refiner. The amount of the polymer of an aliphatic amine contained in the aqueous tin-zinc plating baths of the present invention may range from about 0.5 to about 10 g/l although larger amounts can be utilized in some instances. In one embodiment, the plating baths contain from about 0.5 to about 5 g/l of the polymer of an aliphatic amine.

Typical aliphatic amines which may be used to form polymers include 1,2-alkyleneimine, monoethanolamine, diethanolamine, triethanolamine, ethylenediamine, diethylenetriamine, amino-bis-propylamine, triethylene tetramine, tetraethylene pentemene, hexamethylenediamine, etc.

In one embodiment, the polymers of aliphatic amines utilized in the plating baths of the invention are polymers derived from 1,2-alkyleneimines which may be represented by the general formula

V

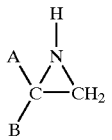

wherein A and B are each independently hydrogen or alkyl groups containing from 1 to about 3 carbon atoms. Where A and B are hydrogen, the compound is ethyleneimine. Compounds wherein either or both A and B are alkyl groups are referred to herein generically as alkyleneimines although such compounds have been referred to also as alkyleneimine derivatives.

Examples of poly(alkyleneimines) which are useful in the present invention include polymers obtained from ethyleneimine, 1,2-propyleneimine, 1,2-butyleneimine and 1,1-dimethylethyleneimine. The poly(alkyleneimines) useful in the present invention may have molecular weights of from about 100 to about 100,000 or more although the higher molecular weight polymers are not generally as useful since they have a tendency to be insoluble in the plating baths of the invention. In one embodiment, the molecular weight will be within the range of from about 100 to about 60,000 and more often from about 150 to about 2000. Useful polyethyleneimines are available commercially from, for example, BASF under the designations Polymin G-15 (molecular weight 150), Polymin G-20 (molecular weight 200) and Polymin G-35 (molecular weight 1400).

The aqueous tin-zinc plating bath of the present invention also may contain at least one metal complexing agent characterized by the formula $$R^3(R^4)N—R^2—N(R^5)R^6 \quad \text{VI}$$

wherein $R^3$, $R^4$, $R^5$, and $R^6$ are each independently alkyl or hydroxyalkyl groups provided that at least one of $R^3$–$R^6$ is a hydroxyalkyl group, and $R^2$ is a hydrocarbylene group containing up to about 10 carbon atoms. The presence of the complexing agent in the plating baths of the invention also results in an improvement of the alloy range over an extended current density, and overall appearance of the deposit, particularly at low current densities (e.g., less than 10 ASF). The amount of such metal complexing agent included in the plating baths of the present invention may vary over a wide range, and generally, the amount of the metal complexing agent will range from about 5 to about 100 g/l, and more often, the amount will be in the range of from about 10 to about 30 g/l. The groups $R^3$–$R^6$ may be alkyl groups containing from 1 to 10 carbon atoms, more often alkyl groups containing from 1 to 5 carbon atoms, or these groups may be hydroxyalkyl groups containing from 1 to 10 carbon atoms, more often from 1 to about 5 carbon atoms. The hydroxyalkyl groups may contain one or more hydroxyl groups, and more often at least one of the hydroxyl groups present in the hydroxyalkyl groups is a terminal group. In one preferred embodiment, $R^3$, $R^4$, $R^5$ and $R^6$ are hydroxyalkyl groups.

Specific examples of metal complexing agents characterized by Formula VI include N-(2-hydroxyethyl)-N,N',N'-triethylethylenediamine; N,N'-di(2-hydroxyethyl)N,N'-diethyl ethylenediamine; N,N-di(2-hydroxyethyl)-N',N'-diethyl ethylenediamine; N,N,N',N'-tetrakis(2-hydroxyethyl)ethylenediamine; N,N,N',N'-tetrakis(2-hydroxyethyl)propylenediamine; N,N,N',N'-tetrakis(2,3-dihydroxypropyl)ethylenediamine; N,N,N',N'-tetrakis(2,3-dihydroxypropyl)propylenediamine; N,N,N',N'-tetrakis(2-hydroxypropyl)ethylenediamine; N,N,N',N'-tetrakis(2-hydroxyethyl)1,4-diaminobutane; etc. An example of a commercially available metal complexing agent useful in this invention includes Quadrol Polyol from BASF. Quadrol Polyol is the reaction product of 1 mole of ethylenediamine with 4 moles of propylene oxide.

The properties of the tin-zinc alloy deposited by the plating baths of the present invention may be enhanced further by including other additives in the baths such as a small amount of the nitrogen-containing compound which is obtained by reacting (a) ammonia, an aliphatic amine containing at least one primary amine group, or mixtures of two or more of any of these, with (b) one or more epihalohydrin, glycerol halohydrin or mixtures thereof. When incorporated in the bath, the bath generally will contain from about 0.10 to about 5 g/l of such nitrogen-containing compound. The preparation of such nitrogen containing compounds is described in, for example, U.S. Pat. No. 2,791,554.

Examples of aliphatic amines which are useful for preparing these compounds include the aliphatic acyclic amines such as methylamine, ethylamine, propylamine, butylamine, etc., and alkylene polyamines having the general formula VII:

$$H_2N\text{-(alkylene NH)}_x\text{ alkylene NH}_2 \quad \text{VII}$$

wherein x is an integer from zero to four and the alkylene may be a straight or branched chain group containing up to about six carbon atoms. Examples of such alkylene polyamines containing at least one primary amine group include ethylene diamine, triethylamine tetramine, propylene diamine, N-ethyl-ethylene diamine, tripropylene tetramine, tetraethylene pentamine and pentaethylene hexamine. Combinations of ammonia with one or more of the aliphatic amines can be reacted with the epoxy compound as well as combinations of the aliphatic acyclic amines.

The epihalohydrins that may be reacted with the ammonia and/or aliphatic amines include epihalohydrins and derivatives of epihalohydrins having the formula

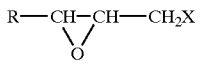

VIII wherein X is halogen and R is hydrogen or a lower alkyl group. Examples of such compounds include epichlorohydrin, epibromohydrin and 1-chloro-2,3-epoxybutane. Epichlorohydrin is preferred. Other compounds having similar reactivity to the epihalohydrins, such as glycerol halohydrins, having the following formula may be utilized:

$$CH_2X—CHX—CH_2X \quad \text{IX}$$

wherein at least one but not more than two of the Xs are hydroxy groups and the remaining Xs are chlorine or bromine. Examples of such reactants include, for example, 1,3-dichloro-2-hydroxypropane, 3-chloro-1,2-dihydroxypropane, and 2,3-dichloro-1-hydroxypropane.

The nitrogen-containing compound utilized in the baths of the invention may be prepared in accordance with the general methods described in U.S. Pat. No. 2,791,554. The reaction products of epichlorohydrin and ammonia or ethylene diamine are described in U.S. Pat. No. 2,860,089, and in U.S. Pat. No. 3,227,638, the reaction product of epichlorohydrin and hexamine is described. The disclosures of those patents are hereby incorporated by reference. Various ratios of the ingredients may be selected although generally the ammonia or aliphatic amines containing one primary amine group are reacted with epihalohydrin or glycerol halohydrin in a molar ratio of at least 2:1. The reaction between aliphatic amines containing two primary amine groups such as ethylene diamine with epihalohydrin or glycerol halohydrin normally is conducted with molar ratios of at least about 1:1. More specifically, the nitrogen-containing compounds utilized in the invention are prepared by mixing the ammonia or amine compound with water in a reaction vessel followed by the addition of the epihalohydrin or glycerol halohydrin while maintaining the reaction temperature below about 60° C. One nitrogen containing compound that is useful in the tin-zinc plating baths of the invention and which exerts a positive grain refining effect on a tin-zinc bath is the reaction product of one mole of ethylenediamine with one mole of epichlorohydrin. This additive also appears to reduce high current density burning.

The tin-zinc electroplating baths of the present invention can be prepared by techniques well known to those skilled in the art, and generally, the ingredients in the particular electroplating bath can be mixed in water with stirring in any order. In one embodiment, the stannous salt, zinc salt, conducting salts and citric acid are added to water in any order followed by the addition of ammonium hydroxide to adjust the pH of the bath. The remaining organic components are added in amounts sufficient to provide the desired concentrations.

In practice of the present invention, the bath is operated at conventional temperatures and an average cathode current density in the range of from 80 ASF to 2 ASF. Typically the cathode current density is about 20 ASF to 15 ASF.

The following examples illustrate the tin-zinc electroplating baths of the present invention and their utility. Unless otherwise indicated in the examples and elsewhere in the specification and claims, all parts and percentages are by weight, temperatures are in degrees centigrade, and pressure is at or near atmospheric pressure.

The utility of the plating baths is demonstrated by plating steel Hull Cell panels in a 267 ml Hull Cell. The testing is conducted at room temperature at 1 amp for 5 to 10 minutes. Current densities are measured with a Hull Cell scale.

| Example 1 | g/l |
|---|---|
| Stannous ion ($SnCl_2$) | 4.3 |
| Zinc ion ($ZnCl_2$) | 8.6 |
| Potassium chloride | 140.0 |
| Citric acid | 100.0 |
| $NH_4OH$ | * |
| Polymin G-35 | 0.4 |
| Mirapol A-15 | 0.2 |
| Water | to make 1 liter |

* sufficient to provide the bath with pH = 6

The Hull Cell panel obtained in this example has a uniform, smooth, white-gray matte deposit from end to end after 10 minutes. The deposited tin-zinc alloy contains from 70–80% tin from 40 ASF down to 15 ASF.

| Example 2 | |
|---|---|
| Stannous ion ($SnCl_2$) | 10.0 |
| Zinc ion ($SnCl_2$) | 10.0 |
| Citric acid | 100.0 |
| Sodium sulfate | 100.0 |
| $NH_4OH$ | * |
| Mirapol A-15 | 8.0 |
| Water | to make 1 liter |
| pH = 6.0 | |

* sufficient to provide the bath with pH = 6

The Hull Cell panel obtained in this example has a white matte deposit with some streaking. The deposited tin-zinc alloy contains 70–80% tin from 10 ASF down to 4 ASF.

| Example 3 | |
|---|---|
| Stannous ion ($SnCl_2$) | 10.0 |
| Zinc ion ($SnCl_2$) | 10.0 |
| Citric acid | 100.0 |
| Sodium sulfate | 100.0 |
| $NH_4OH$ | * |
| Mirapol A-15 | 8.0 |
| Quadrol Polyol | 15 |
| Water | to make 1 liter |

* sufficient to provide the bath with pH = 6

The Hull Cell panel obtained in this example has a uniform, smooth, white-gray tin-zinc deposit containing 70–80% of tin between 40 ASF and 2 ASF.

| Example 4 | |
|---|---|
| Stannous ion ($SnCl_2$) | 10.0 |
| Zinc ion ($SnCl_2$) | 10.0 |
| Citric acid | 100.0 |
| Sodium sulfate | 100.0 |
| $NH_4OH$ | * |
| Mirapol A-15 | 8.0 |
| Quadrol Polyol | 15.0 |
| Polymin G-35 | 2.4 |
| Water | to make 1 liter |

* sufficient to provide the bath with pH = 6

The Hull Cell panel obtained in this example has a smooth, uniform, light gray tin-zinc deposit containing 70–80% tin between 40 ASF and 8 ASF.

| Example 5 | |
|---|---|
| Stannous ion ($SnCl_2$) | 15.0 |
| Zinc ion ($ZnCl_2$) | 30.0 |
| Citric acid | 100.0 |
| Sodium sulfate | 80.0 |
| Ammonium hydroxide | * |
| Quadrol Polyol | 28 |
| Mirapol A-15 | 0.8 |
| Water | to make 1 liter |

* sufficient to provide the bath with pH = 5.3

The Hull Cell panel obtained in this example has a uniform, smooth gray tin-zinc deposit containing 70–80% tin between 40 ASF and 1 ASF.

| Example 6 | |
|---|---|
| Stannous ion ($SnCl_2$) | 10 |
| Zinc ion ($ZnCl_2$) | 15 |
| Citric acid | 100 |
| Sodium sulfate | 80 |
| Quadrol Polyol | 3 |
| Mirapol A-15 | 0.8 |
| Anisaldehyde-bisulfite | 0.008 |
| Ethylene diamine-epichlorohydrin reaction product (1:1 mole) | 4.0 |
| $NH_4OH$ | * |
| Water | to make 1 liter |

* sufficient to provide the bath with pH = 5.6

The Hull Cell panel obtained in this example has a uniform, smooth gray tin-zinc deposit which displays a semibright sheen in the areas between 49 ASF and 5 ASF. The deposit contains 70–80% tin.

| Example 7 | |
|---|---|
| Stannous ion ($SnCl_2$) | 16 |
| Zinc ion ($ZnCl_2$) | 10 |
| Citric acid | 100 |
| Sodium sulfate | 100 |
| $NH_4OH$ | * |
| Mirapol A-15 | 0.8 |
| Quadrol Polyol | 3.5 |
| Water | to make 1 liter |

* sufficient to provide the bath with pH = 6

The Hull Cell panel obtained in this example has a uniform, smooth gray-white tin-zinc deposit after 10 minutes which contains 80–90% tin. The deposit is solderable.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. An aqueous plating bath for electrodeposition of tin-zinc alloys comprising at least one bath-soluble stannous salt, at least one bath soluble zinc salt, and a quaternary ammonium polymer selected from a ureylene quaternary ammonium polymer, an iminoureylene quaternary ammonium polymer or a thioureylene quaternary ammonium polymer.

2. The plating bath of claim 1 wherein the pH of the bath is in the range of from about 4 to about 8.

3. The plating bath of claim 1 wherein the stannous and zinc salts are salts selected from the chloride, bromide, fluoride, sulfate, or oxide salts, or mixtures thereof.

4. The plating bath of claim 1 wherein the bath also contains at least one hydroxy polycarboxylic acid containing from 3 to about 15 carbon atoms, or a water soluble salt thereof.

5. The plating bath of claim 4 wherein the hydroxy polycarboxylic acid is citric acid or a water soluble salt of citric acid.

6. The plating bath of claim 1 wherein the water-soluble stannous salt is present in an amount to provide from about 1 to about 100 g/l of stannous ions.

7. The plating bath of claim 1 wherein the water soluble zinc salt is present in an amount to provide from about 0.1 to about 80 g/l of zinc ions.

8. The plating bath of claim 1 wherein the quaternary ammonium polymer is prepared by reacting (a) at least 2 moles of a diamine containing one tertiary amine group and one primary or secondary amine group with (b) one mole of urea, thiourea or amidine with the removal of ammonia to form a ditertiary amine which is thereafter reacted with (c) a dihalide.

9. The plating bath of claim 8 wherein the diamine (a) is characterized by the Formula II $$(R)(R)N—(CH_2)_a—NHC(Y)NH—(CH_2)_b—N(R)(R) \qquad \text{II}$$

wherein each R is independently a methyl, ethyl, isopropyl, hydroxymethyl, hydroxyethyl, or $—CH_2CH(OCH_2CH_2)_c$ OH group; a, b and c are each independently 1 to about 6; and Y is O, S, or NH.

10. The plating bath of claim 9 wherein Y is O, and a and b are 3.

11. The plating bath of claim 9 wherein the dihalide (c) is characterized by the Formula III $$X—R^1—X \qquad \text{II}$$

wherein X is a halide, and $R^1$ is $(CH_2)_d$ or $-[(CH_2)_eO(CH_2)_f]_g-$ where d, e and f are each independently from 1 to about 6, and g is from 1 to about 4.

12. The plating bath of claim 11 wherein $R^1$ is $-[(CH_2)_e—O—(CH_2)_f]_g-$, e and f are 2, and g is 1.

13. The plating bath of claim 1 wherein the quaternary ammonium polymer is a ureylene quaternary ammonium polymer.

14. The plating bath of claim 13 wherein the ureylene quaternary ammonium polymer is prepared by reacting (a) two moles of a diamine containing one tertiary amine group and one primary or secondary amine group with (b) one mole of urea with the removal of ammonia to form a ditertiary amine which is then reacted with (c) a dihalide.

15. The plating bath of claim 14 wherein the diamine is characterized by the Formula IIa $$(R)(R)N—(CH_2)_a—NHC(O)NH—(CH_2)_b—N(R)(R) \qquad \text{IIa}$$

wherein each R is independently a methyl, ethyl, isopropyl, hydroxymethyl, hydroxyethyl, or $—CH_2CH(OCH_2CH_2)_c$ OH group, and a, b and c are each independently 1 to about 6.

16. The plating bath of claim 15 wherein each R is methyl, and a and b are 3.

17. The plating bath of claim 14 wherein the dihalide is represented by the Formula III $$X—R^1—X \qquad \text{III}$$

where X is a halide, and $R^1$ is $(CH_2)_d$ or $-[(CH_2)_eO(CH_2)_f]-$ wherein d, e and f are each independently from 1 to about 6, and g is from 1 to about 4.

18. The plating bath of claim 17 wherein $R^1$ is $-[(CH_2)_e—O—(CH_2)_f]_g-$ where e and f are each 2 and g is 1.

19. The plating bath of claim 1 also containing from about 50 to about 300 g/l of at least one conductive salt.

20. The plating bath of claim 19 wherein the conductive salt is selected from alkali metal or ammonium halides, sulfates and mixtures thereof.

21. The plating bath of claim 1 wherein the bath also contains an alkali metal hydroxide or ammonium hydroxide in an amount sufficient to provide a plating bath having a pH of from about 4 to about 8.

22. The plating bath of claim 1 also containing an effective amount of at least one supplemental brightener selected from aromatic carbonyl-containing compounds.

23. The plating bath of claim 1 also containing at least one polymer of an aliphatic amine.

24. The plating bath of claim 23 wherein the polymer is a poly(alkyleneimine).

25. The plating bath of claim 1 wherein the bath further contains at least one metal-complexing agent characterized by the formula $$R^3(R^4)N—R^2—N(R^5)R^6 \qquad \text{VI}$$

wherein $R^3$, $R^4$, $R^5$ and $R^6$ are each independently alkyl or hydroxyalkyl groups provided that at least one of $R^3$–$R^6$ is a hydroxyalkyl group, and $R^2$ is a hydrocarbylene group containing up to about 10 carbon atoms.

26. A method of electrodepositing a bright tin-zinc alloy on a substrate which comprises electroplating said substrate in the aqueous plating bath of claim 1.

27. An aqueous plating bath for electrodeposition of tin-zinc alloys comprising at least one bath-soluble tin salt, at least one bath-soluble zinc salt, and a quaternary ammonium polymer characterized by the formula $$-[\overset{\oplus}{N}(R)(R)—(CH_2)_a—N(H)—C(Y)—N(H)—(CH_2)_b—\overset{\oplus}{N}(R)(R)—R^1]_n-\ 2nX^- \qquad \text{IV}$$

wherein each R is independently a methyl, ethyl, isopropyl, hydroxyethyl or $CH_2CH_2—(OCH_2CH_2)_cOH$ group; a, b and c, are each independently from 1 to about 6; Y is O, S or NH; n is at least 1; $R^1$ is $(CH_2)_d$ or $-[(CH_2)_e—O—(CH_2)_f]_g-$ wherein d, e and f are each independently from 1 to about 6, and g is from 1 to about 4; and $X^-$ is a halide ion.

28. The plating bath of claim 27 wherein Y in Formula IV is O, and the quaternary ammonium polymer has a molecular weight of from about 350 to about 3000.

29. The plating bath of claim 27 wherein the pH of the bath is in the range of from about 5 to about 7.

30. The plating bath of claim 27 also containing from about 50 to about 300 g/l of at least one conductive salt.

31. The plating bath of claim 27 also containing citric acid or a water soluble salt of citric acid.

32. The plating bath of claim 27 also containing an effective amount of at least one supplemental brightener selected from aromatic aldehydes and ketones.

33. The plating bath of claim 27 also containing at least one poly(alkyleneimine).

34. The plating bath of claim 27 wherein the bath further contains at least one metal-complexing agent characterized by the formula $$R^3(R^4)N—R^2—N(R^5)R^6 \qquad \text{VI}$$

wherein $R^3$, $R^4$, $R^5$ and $R^6$ are each independently alkyl or hydroxyalkyl groups provided that at least one of $R^3$–$R^6$ is a hydroxyalkyl group, and $R^2$ is a hydrocarbylene group containing up to about 10 carbon atoms.

35. The plating bath of claim 27 containing from about 5 to about 30 g/l of stannous ion and from about 5 to about 50 g/l of zinc ion.

36. A method of electrodepositing a bright tin-zinc alloy on a substrate which comprises electroplating said substrate in the aqueous plating bath of claim 27.

37. An aqueous plating bath for electrodeposition of a tin-zinc alloy comprising:

(A) from about 5 to about 30 g/l of stannous ions, (B) from about 5 to about 50 g/l of zinc ions, (C) from about 0.5 to about 2.0 g/l of a ureylene quaternary ammonium polymer prepared by reacting (a) at least two moles at least one diamine represented by Formula I $$R(R)N—(CH_2)_a—N(R^7)H \qquad \text{I}$$

where each R is independently a methyl, ethyl, isopropyl, hydroxymethyl, hydroxyethyl, or $—CH_2CH(OCH_2CH_2)_c$ OH group, $R^7$ is hydrogen or R, and a is 1 to about 6, with (b) one mole of urea to form a ditertiary amine which is then reacted with (c) a dihalide represented by Formula IIIa $$X—(CH_2)_eO(CH_2)_f—X \qquad \text{IIIa}$$

where X is a halide and e and f are each independently 2 or 3, and (D) at least two moles of at least one hydroxy polycarboxylic acid per mole of combined stannous and zinc ions in the plating bath.

38. The plating bath of claim 37 wherein in Formula I, each R is methyl, $R^7$ is hydrogen, a is 3, and in Formula IIIa, X is chlorine and e and f are 2.

39. The plating bath of claim 37 also containing (E) from about 50 to about 300 g/l of at least one conductive salt.

40. The plating bath of claim 39 also containing (F) from about 0.5 to about 5 g/l of a poly(alkyleneimine).

41. The plating bath of claim 40 wherein the poly (alkyleneimine) is a poly(ethyleneimine) having a molecular weight of from about 100 to about 100,000.

42. The plating bath of claim 39 also containing (G) from about 10 to about 30 g/l of at least one metal complexing agent characterized by the formula $$R^3(R^4)N—R^2—N(R^5)R^6 \qquad \text{VI}$$

wherein $R^3$, $R^4$, $R^5$ and $R^6$ are each independently alkyl or hydroxyalkyl groups provided that at least one of $R^3$–$R^6$ is a hydroxyalkyl group, and $R^2$ is a hydrocarbylene group containing up to about 10 carbon atoms.

43. The plating bath of claim 37 wherein the quaternary ammonium polymer has a molecular weight of from about 300 to about 3000.

44. The plating bath of claim 37 wherein the hydroxy polycarboxylic acid (D) is citric acid.

45. The plating bath of claim 37 also containing an effective amount of at least one supplemental brightener selected from aromatic carbonyl-containing compounds or their water soluble salts.

46. A method of electrodepositing a bright tin-zinc alloy on a substrate which comprises electroplating said substrate in the aqueous plating bath of claim 37.

* * * * *